US011975883B2

(12) United States Patent
Vissers

(10) Patent No.: US 11,975,883 B2
(45) Date of Patent: May 7, 2024

(54) DISCHARGING DEVICE FOR A VERTICAL FORM FILL AND SEAL MACHINE AND VERTICAL FORM FILL AND SEAL MACHINE WITH SUCH A DISCHARGING DEVICE

(71) Applicant: Syntegon Packaging Solutions B.V., Weert (NL)

(72) Inventor: Eugene Vissers, Weert (NL)

(73) Assignee: Syntegon Packaging Solutions B.V., Weert (NL)

( * ) Notice: Subject to any disclaimer, the term of this patent is extended or adjusted under 35 U.S.C. 154(b) by 0 days.

(21) Appl. No.: 17/954,413

(22) Filed: Sep. 28, 2022

(65) Prior Publication Data

US 2023/0096337 A1 Mar. 30, 2023

(30) Foreign Application Priority Data

Sep. 28, 2021 (DE) ..... 10 2021 125 158.3

(51) Int. Cl.
*B65B 61/28* (2006.01)
*B65B 9/08* (2012.01)
(Continued)

(52) U.S. Cl.
CPC ..... *B65B 61/28* (2013.01); *B65B 9/08* (2013.01); *B65B 41/16* (2013.01); *B65B 51/30* (2013.01)

(58) Field of Classification Search
CPC .. B65B 9/08; B65B 9/20; B65B 61/28; B65B 51/30; B65B 41/16
See application file for complete search history.

(56) References Cited

U.S. PATENT DOCUMENTS 5,570,569 A * 11/1996 Masuda ..... B65B 9/213 53/372.2
6,186,304 B1 * 2/2001 Hakansson ..... B28C 5/4251 193/6
(Continued)

FOREIGN PATENT DOCUMENTS

DE 3141431 A1 3/1983
DE 69502655 T2 11/1996
(Continued)

OTHER PUBLICATIONS

German Patent Office Action for Related Application No. DE102021125158.3 dated Jun. 17, 2022 (13 pages, with an English translation).
(Continued)

*Primary Examiner* — Thomas M Wittenschlaeger
(74) *Attorney, Agent, or Firm* — Michael Best & Friedrich LLP

(57) ABSTRACT

A discharging device for a vertical form fill and seal machine includes at least one transfer unit (14) to transfer sealed bags (16) from a sealing device (18) of the vertical form fill and seal machine to a transport device (20) located downstream with respect to the vertical form fill and seal machine. The transfer unit (14) comprises at least one transfer element (22) arrangeable between the sealing device (18) and the transport device (20), wherein the transfer element (22) is provided to change an orientation of the sealed bags (16) during a transfer from the sealing device (18) to the transport device (20). The transfer element (22) is embodied as a chute with two opposite arranged sliding wings (24, 26) on which the sealed bags (16) can slide during a transfer from the sealing device (18) to the transport device (20).

16 Claims, 4 Drawing Sheets

(51) Int. Cl.
*B65B 41/16* (2006.01)
*B65B 51/30* (2006.01)

(56) References Cited

U.S. PATENT DOCUMENTS

| | | | | |
|---|---|---|---|---|
| 2007/0119632 | A1* | 5/2007 | Noumi | B65B 9/213 177/58 |
| 2019/0352096 | A1* | 11/2019 | McNeilus | B28C 5/4251 |

FOREIGN PATENT DOCUMENTS

| | | | | |
|---|---|---|---|---|
| EP | 2955117 | B1 * | 3/2017 | B65B 61/06 |
| EP | 2911947 | B1 | 3/2018 | |
| JP | S5475754 | A | 6/1979 | |
| JP | H0534107 | U | 5/1993 | |
| JP | 2002068123 | A | 3/2002 | |
| JP | 2007131339 | A | 5/2007 | |
| JP | 2007223671 | A | 9/2007 | |
| JP | 2011219138 | A | 11/2011 | |

OTHER PUBLICATIONS

European Patent Office Extended Search Report for Application No. 22197794.5 dated Apr. 12, 2023 (11 pages).

* cited by examiner

DISCHARGING DEVICE FOR A VERTICAL FORM FILL AND SEAL MACHINE AND VERTICAL FORM FILL AND SEAL MACHINE WITH SUCH A DISCHARGING DEVICE

BACKGROUND

A discharging device for a vertical form fill and seal machine, comprising at least one transfer unit to transfer sealed bags from a sealing device of the vertical form fill and seal machine to a transport device located downstream with respect to the vertical form fill and seal machine, wherein the transfer unit comprises at least one transfer element arrangeable between the sealing device and the transport device, wherein the transfer element is provided to change an orientation of the sealed bags during a transfer from the sealing device to the transport device, has already been proposed. The well-known transfer element has at least one sliding wing and/or is actively moved for changing an orientation of the sealed bags during a transfer from the sealing device to the transport device.

Such discharging devices are well known from JP 2007-223 671 A, JP 2007-131 339 A, DE 31 41 431 A1, JP 2002-68 123 A and DE 695 02 655 T2.

SUMMARY

The invention is based on a discharging device for a vertical form fill and seal machine, comprising at least one transfer unit to transfer sealed bags, in particular tubular pouches, from a sealing device of the vertical form fill and seal machine to a transport device located downstream with respect to the vertical form fill and seal machine, wherein the transfer unit comprises at least one transfer element arrangeable, in particular arranged, between the sealing device and the transport device, wherein the transfer element is provided to change an orientation of the sealed bags during a transfer from the sealing device to the transport device.

It is proposed that the transfer element is embodied as a chute with two opposite arranged sliding wings on which the sealed bags can slide during a transfer from the sealing device to the transport device, wherein viewed along the main transportation direction of the transport unit, the transfer element has a tapered shape, wherein the sliding wings, in particular the sliding surfaces of the sliding wings, have an inclination relative to each other. Preferably, the sealed bags are discharged from the sealing device, in particular a cross sealing unit of the sealing device, into the transfer element for a transfer to the transport device, in particular after a cross sealing process of the cross sealing unit, which is well known to a person skilled in the art. In particular, the sealed bags are directly discharged from the sealing device into the transfer element, especially after a second cross seal seam is generated and the sealed bags are cut away from the tube-like material the sealed bags are made of. It is also conceivable that the discharge device or the vertical form fill and seal machine comprises at least one intermediate element, for example a transfer ramp, a transfer robot, a transfer belt or the like, arranged between the transfer element and the sealing device to transfer the sealed bags from the sealing device to the transfer element. Preferably, the sealed bags are discharged on one side of the transfer element. In particular, after the sealed bags are released from the tube-like material the sealed bags are made of and are discharged from the sealing device into the transfer element, the sealed bags slide from one side of the transfer element to an opposite side of the transfer element a few (normally one or two) times, in particular the sealed bags slide from one of the sliding wings to the other of the sliding wings, especially along sliding surfaces of the sliding wings. The sliding wings are preferably arranged on different sides of the transfer element. In particular, one of the sliding wings is arranged on a left side of the transfer element and the other of the sliding wings is arranged on a right side of the transfer element, especially viewed along a main transportation direction of the transport device. Preferably, the sliding wings form sides walls of the transfer element.

Preferably, the sealed bags are discharged form the sealing device into the transfer element in such an orientation that the cross seal seams of the sealed bags are oriented at least substantially parallel to the sliding surfaces of the sliding wings and/or to the main transportation direction of the transport device. In particular, after the sealed bags are transferred to the transport device, in particular a transport belt of the transport device, by the transfer unit, the cross seal seams of the sealed bags are oriented at least substantially perpendicular to the main transportation direction of the transport device. The term "substantially parallel" is here in particular to mean an orientation of a direction relative to a reference direction, in particular in a plane, wherein the direction relative to the reference direction has a deviation smaller than 20°, advantageously smaller than 10° and especially advantageously smaller than 5°. The term "substantially perpendicularly" is here in particular to mean an orientation of a direction relative to a reference direction, wherein the direction and the reference direction, in particular viewed in a projection plane, include a 90° angle and the angle has a maximum deviation of in particular less than 20°, advantageously less than 10° and especially advantageously less than 5° of the 90° angle.

The sliding wings, in particular the sliding surfaces of the sliding wings, can have an inclination relative to each other or the sliding wings are oriented at least substantially parallel to each other. The sliding wings, in particular the sliding surfaces of the sliding wings, can have an inclination relative to the main transportation direction and/or relative to a transportation plane of the transport device. When the sliding wings, in particular the sliding surfaces of the sliding wings, have an inclination relative to each other than the sliding wings, in particular the sliding surfaces of the sliding wings, form an angle of less than 45°, advantageously of less than 40°, and especially advantageously of less than 35° with each other, viewed in a vertical plane, in particular in a cross plane of the transfer element.

Preferably, the transfer element is made out of one piece, especially made out of one piece of metal, especially stainless steel. Preferably, the transfer element is made out of one piece of metal and is bent in the required shape according to functional regions of the transfer element, like a sliding function of the sliding wings, on which the sealed bags can slide during a transfer from the sealing device to the transport device, for example. The transfer element has for example a shape like a halfpipe in a winter sports fun park. The sliding wings preferably are implemented integrally with each other. It is also conceivable that the transfer element is made out of another material that is deemed expedient by someone skilled in the art, like plastic or the like, or that the transfer element has a multipart design, wherein the components of the transfer element are rigidly fixed to each other. "Implemented integrally" is in particular to mean connected at least by substance-to-substance bond, for example by a welding process, a gluing process, an injection-molding process, and/or another process that is deemed expedient by someone skilled in the art, and/or advantageously formed in one piece, like for example by a production from a cast and/or by a production in a one-component or multi-component injection-molding procedure, and advantageously from a single blank. Preferably, the transfer element has a tapered shape viewed along the main transportation direction of the transport unit.

With a discharging device according to the invention the transfer unit can be kept advantageously simple. An advantageously low number of parts which have not to be actively moved during a transfer process can be advantageously achieved. With a discharging device according to the invention low costs due to the simple design, handling and robust functioning can be achieved. Advantageously, low forces act onto the sealed bags, so that a risk of a damage of the sealed bags during the transfer process can be advantageously kept low. A large variation in bag styles can advantageously be handled via the discharge device according to the invention, especially without an adjustment. Advantageously, the sealed bags can be released at the same position for every bag size, resulting in a smaller required transport belt width. It is advantageously possible to easy change a bag orientation (print up or down) by installing the discharging device in a different position relative to the transport device, especially no different mechanical parts are needed.

It is further proposed that the transfer element comprises at least one, in particular planar, middle surface which connects the two sliding wings with each other. Preferably, the middle surface is implemented integrally with the two sliding wings. In particular, the two sliding wings directly extend into the middle surface. The sliding wings can have rounded passages to run into the middle surface or the sliding wings can have angled segments to run into the middle surface. The sliding wings themselves can have an arcuate shape or can be divided in single segments which are inclined relative to each other, especially viewed along a direction starting from free ends of the sliding wings and running to the middle surface. According to at least one embodiment of the discharging device according to the invention, the transfer element preferably comprises interim passages between the sliding wings and the middle surface which are rounded or which are divided in angled segments to connect the sliding wings with the middle surface. With a discharging device according to the invention constructive simple sliding surfaces along which the sealed bag can slide during a transfer from the sealing device to the transport device can be achieved. Advantageously, low forces act onto the sealed bags, so that a risk of a damage of the sealed bags during the transfer process can be advantageously kept low. With a discharging device according to the invention the transfer unit can be kept advantageously simple. An advantageously low number of parts which have not to be actively moved during a transfer process can be advantageously achieved.

Furthermore, it is proposed that the transfer element comprises at least one, in particular planar, middle surface, in particular the above-mentioned middle surface, which connects the two sliding wings with each other, wherein the middle surface is, in particular viewed on a side of the transfer element facing towards the vertical form fill and seal machine, inclined, in particular with an angle between 0° and 90°, relative to a cross plane of the transfer element, in particular the above-mentioned cross plane of the transfer element, which extends at least substantially perpendicular to sliding surfaces of the sliding wings, in particular the above-mentioned sliding surfaces of the sliding wings. Preferably, the middle surface, in particular viewed on a side of the transfer element facing towards the vertical form fill and seal machine, is inclined with an angle between 10° and 80°, advantageously with an angle between 30° and 80° and especially advantageously with an angle between 60° and 75° relative to the cross plane of the transfer element. Preferably, the middle surface, in particular viewed on a side of the transfer element facing away from the vertical form fill and seal machine, is inclined with an angle between 90° and 180°, advantageously with an angle between 100° and 160° and especially advantageously with an angle between 105° and 135° relative to the cross plane of the transfer element. The cross plane of the transfer element runs preferably at least substantially perpendicular to the main transportation direction of the transport device, in particular of the transport belt. In particular, the cross plane of the transfer element runs preferably at least substantially perpendicular to the transportation plane of the transport device, in particular of the transport belt. With a discharging device according to the invention the transfer unit can be kept advantageously simple. Advantageously, low forces act onto the sealed bags, so that a risk of a damage of the sealed bags during the transfer process can be advantageously kept low. A precise and repeatable transfer of the sealed bags from the sealing device to the transport device can be advantageously achieved.

Moreover, it is proposed that the transfer element, viewed in a, in particular the above-mentioned, cross plane of the transfer element, which extends at least substantially perpendicular to, in particular the above-mentioned, sliding surfaces of the sliding wings, has a cross section with an angled and/or an arcuate extension. Furthermore, it is proposed that the transfer element, viewed in another cross plane of the transfer element, which extends at least substantially perpendicular to the cross plane, has another cross section with an angled and/or an arcuate extension. In particular, the shape of the cross section is defined by shapes of the sliding wings and the middle surface, viewed in the cross plane of the transfer element, which extends at least substantially perpendicular to the sliding surfaces of the sliding wings. Preferably, the middle surface has a planar or linear shape or extension, viewed in the cross plane of the transfer element, which extends at least substantially perpendicular to the sliding surfaces of the sliding wings. The sliding wings, viewed in the cross plane of the transfer element, which extends at least substantially perpendicular to the sliding surfaces of the sliding wings, have preferably a curved shape or a shape divided into angled segments, in particular until the sliding wings run into the middle surface. Preferably, the cross section of the transfer element as a whole, starting from a free end of one of the sliding wings, has a curved shape or a shape divided into segments before running into a planar or linear section which is formed by the middle surface and then another curved shape or a shape divided into segments running into a free end of the other of the sliding wings. A vertical position of points arranged in the middle surface preferably decreases in the main transportation direction relative to the transportation plane, in particular through the inclined embodiment of the middle surface. Preferably, a distance between the two sliding wings is decreasing along main transportation direction. In particular, a distance between a point on one of the sliding wings and a point on the other of the sliding wing, which are arranged in the same height relative to the transportation plane is decreasing in main transportation direction. With a discharging device according to the invention the transfer unit can be kept advantageously simple. Advantageously, low forces act onto the sealed bags, so that a risk of a damage of the sealed bags during the transfer process can be advantageously kept low. A precise and repeatable transfer of the sealed bags from the sealing device to the transport device can be advantageously achieved. Advantageously, a simple constructional solution to orientate the sealed bags can be achieved. Advantageously, a reliable support of the sealed bags during a transfer from the sealing device can be achieved.

It is further proposed that the transfer element has a U-shaped cross section, viewed in a, in particular the above-mentioned, cross plane of the transfer element, which extends at least substantially perpendicular to, in particular the above-mentioned, sliding surfaces of the sliding wings. Preferably, the sliding wings form the "left and right wings" of the "U-shape" and the middle surface forms the "connecting wing" of the "U-shape" arranged between the "left and right wings" of the "U-shape". The sliding wings are preferably inclined relative to the transportation plane of the transport device, in particular of the transport belt. In particular, each of the sliding wings form together with the transportation plane of the transport device, in particular of the transport belt, an angle less than 90° advantageously an angle less than 85° and especially advantageously an angle less than 80°. Advantageously, a soft discharge of the sealed bags from the sealing device to the transfer element can be achieved. With a discharging device according to the invention the transfer unit can be kept advantageously simple. Advantageously, low forces act onto the sealed bags, so that a risk of a damage of the sealed bags during the transfer process can be advantageously kept low. A precise and repeatable transfer of the sealed bags from the sealing device to the transport device can be advantageously achieved. Advantageously, a simple constructional solution to orientate the sealed bags can be achieved. Advantageously, a reliable support of the sealed bags during a transfer from the sealing device can be achieved.

It is further proposed that the transfer unit comprises an extension element arranged on at least one of the sliding wings, wherein the extension element lengthens a maximum extension of the at least one sliding wing on which the extension element is arranged compared to a maximum extension of the at least one sliding wing which is free of the extension element, viewed along a direction which is at least substantially parallel to a cross plane of the transfer element, which extends at least substantially perpendicular to sliding surfaces of the sliding wings. The extension element can be implemented integrally with the at least one of the sliding wings. It is also conceivable that the extension element can be embodied separate to the at least one of the sliding wings and be fixed to the at least one of the sliding wings via positive or non-positive connection method that is deemed expedient by someone skilled in the art. Preferably, the extension element is provided to bridge a distance between the sealing device and the transfer element, especially the sealing device and the at least one of the sliding wings. Advantageously, the sealed bags can be in contact with the extension element before second cross seal seams are finished and before the sealed bags are completely discharged from the sealing device into the transfer element, so that the sealed bags can advantageously slide along at least one of the sliding surfaces with less stress for the sealed bags. Advantageously, a soft discharge of the sealed bags from the sealing device to the transfer element can be achieved. With a discharging device according to the invention the transfer unit can be kept advantageously simple. Advantageously, low forces act onto the sealed bags, so that a risk of a damage of the sealed bags during the transfer process can be advantageously kept low. A precise and repeatable transfer of the sealed bags from the sealing device to the transport device can be advantageously achieved. Advantageously, a simple constructional solution to orientate the sealed bags can be achieved. Advantageously, a reliable support of the sealed bags during a transfer from the sealing device can be achieved.

Moreover, a vertical form fill and seal machine comprising at least one sealing device and at least one discharging device according to the invention to discharge sealed bags to the transport device is proposed. Preferably, the sealed bags discharged to the transport device are sealed before discharging by the sealing device of the vertical form fill and seal machine. It is conceivable that the transport device is an integral part of the vertical form fill and seal machine or that the transport device is formed separate to the vertical form fill and seal machine and forms a production system together with the vertical form fill and seal machine. In particular, the vertical form fill and seal machine is configured to form a bag, in particular a tubular pouch, out of a film material, to longitudinal seal and to cross seal the bag and to fill the bag with a product in a manner that is well known for someone skilled in the art. Preferably, the film material is stored on a reel that is suspended at or within the vertical form fill and seal machine until processed by the vertical form fill and seal machine. The vertical form fill and seal machine comprises preferably a bearing to mount at least one reel of film material. Preferably, the vertical form fill and seal machine comprises a splicing device to splice the film material from a used-up reel of film material with the film material of a new reel of film material. Optionally, the vertical form fill and seal machine comprises a printing device to imprint the film material. The vertical form fill and seal machine comprises optionally a labelling device to affix a label to the film material. Optionally, the vertical form fill and seal machine comprises a punching device to punch at least one hole into the film material. Preferentially, the vertical form fill and seal machine comprises a forming device to form bags, especially a doy bag or the like, out of the film material, wherein the bags can comprise a zipper or not. Preferentially, the vertical form fill and seal machine comprises a filling device to fill the bags formed out of the film material with the product for packaging, in particular by means of a filling pipe. Preferentially, the vertical form fill and seal machine comprises the sealing device to seal the bags formed out of the film material. The sealing device preferably comprises at least one longitudinal sealing unit to generate at least one longitudinal sealing seam at the bags and at least the above-mentioned cross sealing unit to generate at least one cross sealing seam at the bags, in particular in a manner which is well known to a person skilled in the art. With a vertical form fill and seal machine according to the invention the transfer unit can be kept advantageously simple. An advantageously low number of parts which have not to be actively moved during a transfer process can be advantageously achieved. With a discharging device according to the invention low costs due to the simple design, handling and robust functioning can be achieved. Advantageously, low forces act onto the sealed bags, so that a risk of a damage of the sealed bags during the transfer process can be advantageously kept low. A large variation in bag styles can advantageously be handled via the discharge device according to the invention, especially without an adjustment. Advantageously, the sealed bags can be released at the same position for every bag size, resulting in a smaller required transport belt width. It is advantageously possible to easy change a bag orientation (print up or down) by installing the discharging device in a different position relative to the transport device, especially no different mechanical parts are needed.

Furthermore, it is proposed that the transfer element comprises at least one, in particular planar, middle surface, in particular the above-mentioned middle surface, which connects the two sliding wings with each other, wherein the middle surface is inclined relative to a, in particular the above-mentioned, transportation plane of the transport device and/or relative to a, in particular the above-mentioned, main transportation direction of the transport device. Preferably, the middle surface is inclined with an angle less than 45°, advantageously with an angle less than 35° and especially advantageously with an angle between 5° and 30° relative to the transportation plane of the transport device, in particular of the transport belt, and/or relative to the main transportation direction of the transport device. Advantageously, low forces act onto the sealed bags, so that a risk of a damage of the sealed bags during the transfer process can be advantageously kept low.

Moreover, it is proposed that the transfer unit comprises at least one ramp element arranged between the transfer unit and the transport device, wherein the ramp element is inclined relative to a, in particular the above-mentioned, transportation plane of the transport device and/or relative to a, in particular the above-mentioned, main transportation direction of the transport device. The ramp element can be implemented integrally with the transfer element, in particular with the middle surface, or the ramp element can be embodied separate to the transfer element, wherein the ramp element is arranged next to the transfer element or fixed to the transfer element. Preferably, the ramp element is inclined with an angle less than 45°, advantageously with an angle less than 35° and especially advantageously with an angle between 5° and 30° relative to the transportation plane of the transport device, in particular of the transport belt, and/or relative to the main transportation direction of the transport device. An angle with which the ramp element is inclined relative to the transportation plane of the transport device, in particular of the transport belt, and/or relative to the main transportation direction of the transport device can have the same value as the angle with which the middle surface is inclined relative to the transportation plane of the transport device, in particular of the transport belt, and/or relative to the main transportation direction of the transport device. Preferably, a value of the angle with which the ramp element is inclined relative to the transportation plane of the transport device, in particular of the transport belt, and/or relative to the main transportation direction of the transport device differs from a value of the angle with which the middle surface is inclined relative to the transportation plane of the transport device, in particular of the transport belt, and/or relative to the main transportation direction of the transport device. With a vertical form fill and seal machine according to the invention a gentle transfer from the transfer unit to the transport device can be achieved. Advantageously, low forces act onto the sealed bags, so that a risk of a damage of the sealed bags during the transfer process can be advantageously kept low.

It is further proposed that the vertical form fill and seal machine comprises an adjusting unit by which the transfer unit is moveably supported to adjust a position of the transfer unit relative to the transport device, in particular at least a transfer angle of a middle surface of the transfer element relative to a transportation plane of the transport device and/or an angle of a ramp element of the transfer unit relative to a transportation plane of the transport device. The adjusting unit can be configured to adjust a position of the transfer unit relative to the transport device stepless or in steps. With a vertical form fill and seal machine according to the invention a large variation in bag styles can advantageously be handled via the discharge device according to the invention. It is advantageously possible to easy change a bag orientation (print up or down) by installing the discharging device in a different position relative to the transport device, especially no different mechanical parts are needed.

Furthermore, a production system comprising at least one vertical form fill and seal machine according to the invention and at least one transport device located downstream with respect to the vertical form fill and seal machine is proposed. The transport device is preferably embodied as a steady conveyor device, for example a belt conveyor device, a chain conveyor device or the like. With a production system according to the invention low forces act onto the sealed bags, so that a risk of a damage of the sealed bags during the transfer process can be advantageously kept low. Advantageously, the sealed bags can be released at the same position for every bag size, resulting in a smaller required transport belt width. It is advantageously possible to easy change a bag orientation (print up or down) by installing the discharging device in a different position relative to the transport device, especially no different mechanical parts are needed.

The discharging device according to the invention, the vertical form fill and seal machine according to the invention and/or the production system according to the invention shall herein not be limited to the application and implementation described above. In particular, in order to fulfill a functionality that is described here, the discharging device according to the invention, the vertical form fill and seal machine according to the invention and/or the production system according to the invention may comprise a number of individual elements, components and units that differs from a number given here. Moreover, concerning the value ranges given in the present disclosure, values within the limits mentioned shall also be considered to be disclosed and to be usable as applicable.

BRIEF DESCRIPTION OF THE DRAWINGS

Further advantages will become apparent from the following description of the drawing. In the drawing one exemplary embodiment of the invention is illustrated. The drawing, the description and the claims contain a plurality of features in combination. Someone skilled in the art will purposefully also consider the features individually and will find further expedient combinations.

It is shown in.

DETAILED DESCRIPTION

Figure 1:
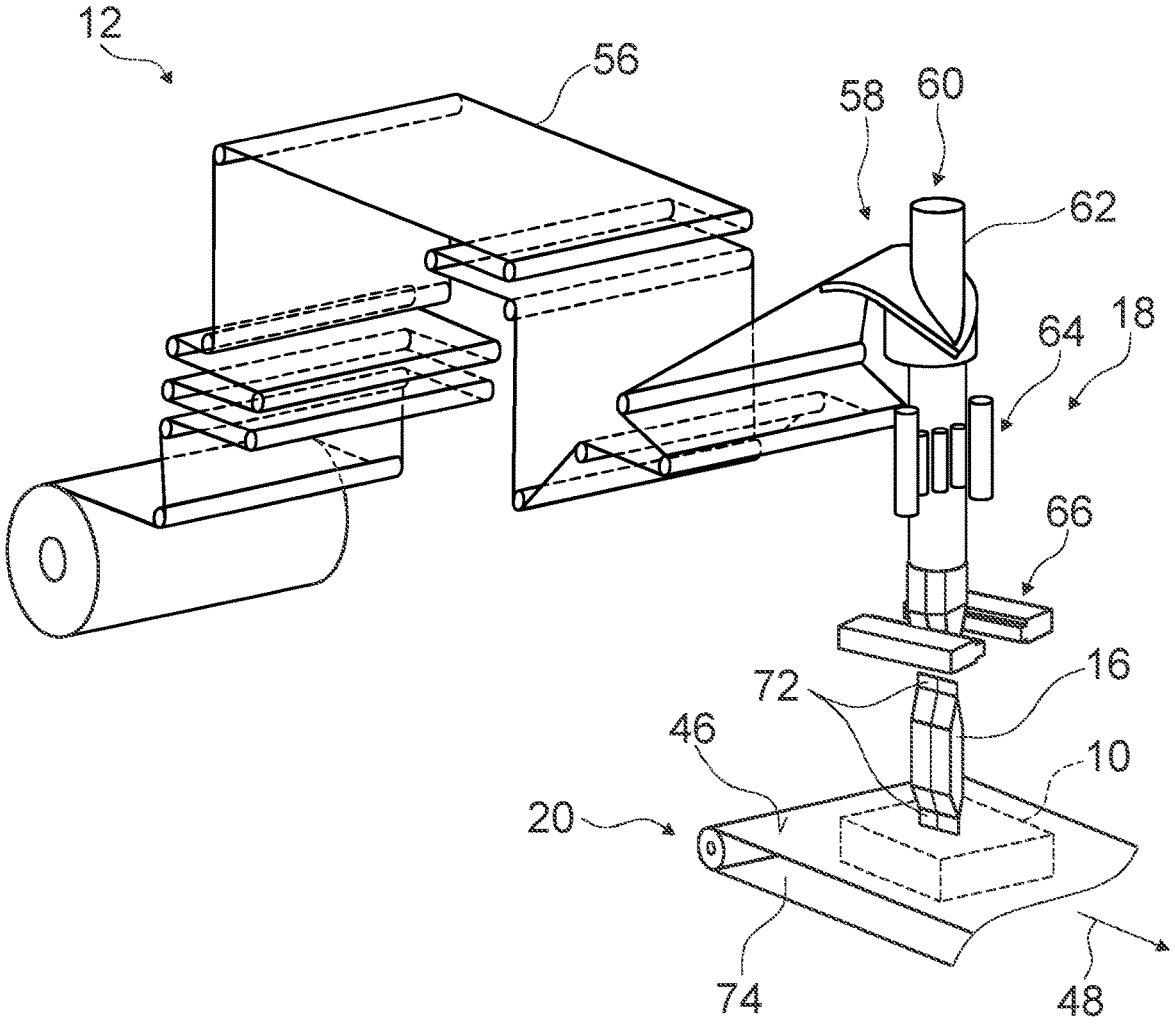
FIG. 1 A production system according to the invention having a vertical form fill and seal machine according to the invention with a discharging device according to the invention, in a schematic representation, FIG. 2 a side view of the discharging device according to the invention, in schematic representation, FIG. 3 a front view of the discharging device according to the invention, in schematic representation, FIG. 4 a projection view of the discharging device according to the invention, in schematic representation and FIG. 5 another projection view of the discharging device according to the invention, in schematic representation.

In FIG. 1 a production system having a vertical form fill and seal machine 12 is shown. The vertical form fill and seal machine 12 comprises at least one sealing device 18, at least one transport device 20 and at least one discharging device 10. In particular, the vertical form fill and seal machine 12 is configured to form a bag, in particular a tubular pouch, out of a film material 56, to longitudinal seal and to cross sealed bags 16 and to fill the bags 16 with a product in a manner that is well known for someone skilled in the art. Preferably, the film material 56 is stored on a reel that is suspended at or within the vertical form fill and seal machine 12 until processed by the vertical form fill and seal machine 12. Preferentially, the vertical form fill and seal machine 12 comprises a forming device 58 to form the bags 16, especially doy bags or the like, out of the film material 56, wherein the bags 16 can comprise a zipper or not. Preferentially, the vertical form fill and seal machine 12 comprises a filling device 60 to fill the bags 16 formed out of the film material 56, in particular by means of a filling pipe 62. Preferentially, the vertical form fill and seal machine 12 comprises the sealing device 18 to seal the bags 16 formed out of the film material 56. The sealing device 18 preferably comprises at least one longitudinal sealing unit 64 to generate at least one longitudinal sealing seam at the bags 16 and at one cross sealing unit 66 to generate at least one cross sealing seam at the bags 16, in particular in a manner which is well known to a person skilled in the art.

The discharging device 10 for the vertical form fill and seal machine 12 comprises at least one transfer unit 14 (see FIGS. 2 to 5) to transfer sealed bags 16 from the sealing device 18, in particular from the cross sealing unit 66, of the vertical form fill and seal machine 12 to a transport device 20 of the vertical form fill and seal machine 12, wherein the transfer unit 14 comprises at least one transfer element 22 arrangeable, in particular arranged, between the sealing device 18 and the transport device 20, wherein the transfer element 22 is provided to change an orientation of the sealed bags 16 during a transfer from the sealing device 18 to the transport device 20. The transfer element 22 is embodied as a chute with two opposite arranged sliding wings 24, 26 on which the sealed bags 16 can slide during a transfer from the sealing device 18 to the transport device 20 (see FIGS. 2 to 5). The transfer element 22 has a U-shaped cross section 38, viewed in a cross plane 32 of the transfer element 22, which extends at least substantially perpendicular to sliding surfaces 34, 36 of the sliding wings 24, 26.

Preferably, the sealed bags 16 are discharged from the sealing device 18, in particular the cross sealing unit 66 of the sealing device 18, into the transfer element 22 for a transfer to the transport device 20, in particular after a cross sealing process of the cross sealing unit 66 is finished, wherein the cross sealing process is well known to a person skilled in the art. In particular, the sealed bags 16 are directly discharged from the sealing device 18 into the transfer element 22, especially after a second cross seal seam is generated and the sealed bags 16 are cut away from the tube-like film material 56 the sealed bags 16 are made of. Preferably, the sealed bags 16 are discharged on one side of the transfer element 22. In particular, after the sealed bags 16 are cut away from the tube-like film material 56 the sealed bags 16 are made of and are discharged from the sealing device 18 into the transfer element 22, the sealed bags 16 slide from one side 68 of the transfer element 22 to an opposite side 70 of the transfer element 22 a few (normally one or two) times, in particular the sealed bags 16 slide from one of the sliding wings 24, 26 to the other of the sliding wings 24, 26, especially along sliding surfaces 34, 36 of the sliding wings 24, 26. The sliding wings 24, 26 can be coated to minimize a friction between the sealed bags 16 and the sliding wings 24, 26 during a transfer from the sealing device 18 to the transport device 20. The sliding wings 24, 26 are preferably arranged on different sides 68, 70 of the transfer element 22. In particular, one of the sliding wings 24, 26 is arranged on a left side 68 of the transfer element 22 and the other of the sliding wings 24, 26 is arranged on a right side 70 of the transfer element 22, especially viewed along a main transportation direction 48 of the transport device 20.

Preferably, the sealed bags 16 are discharged from the sealing device 18 into the transfer element 22 in such an orientation that cross seal seams 72 of the sealed bags 16 are oriented at least substantially parallel to the sliding surfaces 34, 36 of the sliding wings 24 26 and/or to the main transportation direction 48 of the transport device 20. In particular, after the sealed bags 16 are transferred to the transport device 20, in particular to a transport belt 74 or the like of the transport device 20, by the transfer unit 14, the cross seal seams 72 of the sealed bags 16 are oriented at least substantially perpendicular to the main transportation direction 48 of the transport device 20. The sliding wings 24, 26, in particular the sliding surfaces 34, 36 of the sliding wings 24, 26, can have an inclination relative to each other or the sliding wings 24, 26 are oriented at least substantially parallel to each other. The sliding wings 24, 26, in particular the sliding surfaces 34, 36 of the sliding wings 24, 26, can have an inclination relative to the main transportation direction 48 and/or relative to a transportation plane 46 of the transport device 20. When the sliding wings 24, 26, in particular the sliding surfaces 34, 36 of the sliding wings 24, 26, have an inclination relative to each other than the sliding wings 24, 26, in particular the sliding surfaces 34, 36 of the sliding wings 24, 26, form an angle of less than 160°, advantageously of less than 120°, and especially advantageously of less than 90°, viewed in a vertical plane, in particular in a cross plane 32 of the transfer element 22, with each other (see FIGS. 2 to 5). Preferably, the sliding wings 24, 26, in particular the sliding surfaces 34, 36 of the sliding wings 24, 26, form an angle of less than 45°, advantageously of less than 40°, and especially advantageously of less than 35°, viewed in a vertical plane, in particular in a cross plane 32 of the transfer element 22, with each other (see FIGS. 2 to 5).

Figure 3:
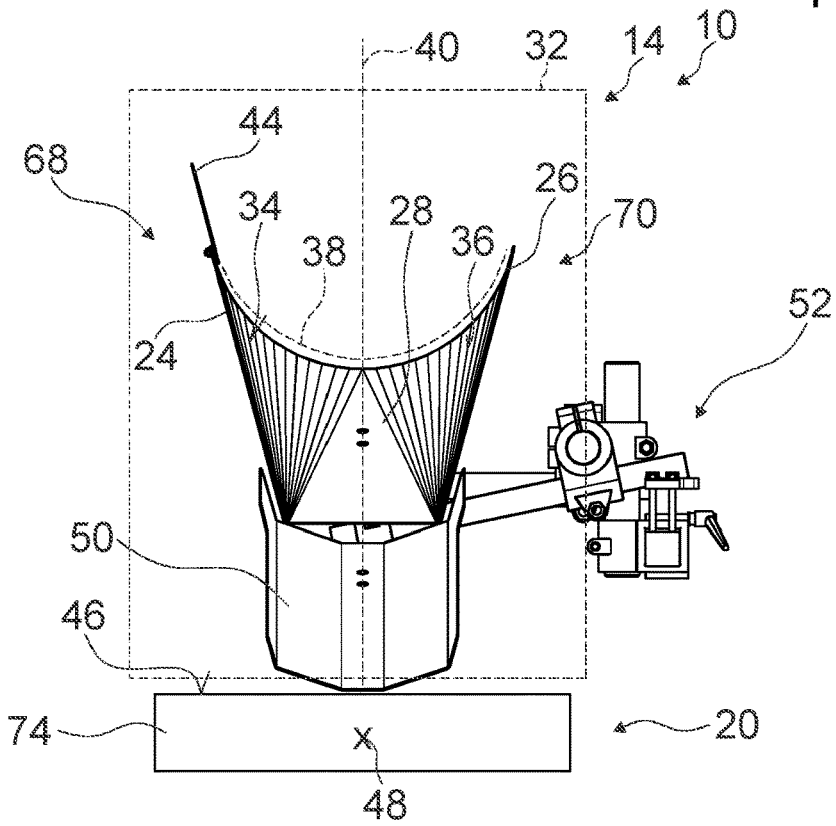
Figure 4:
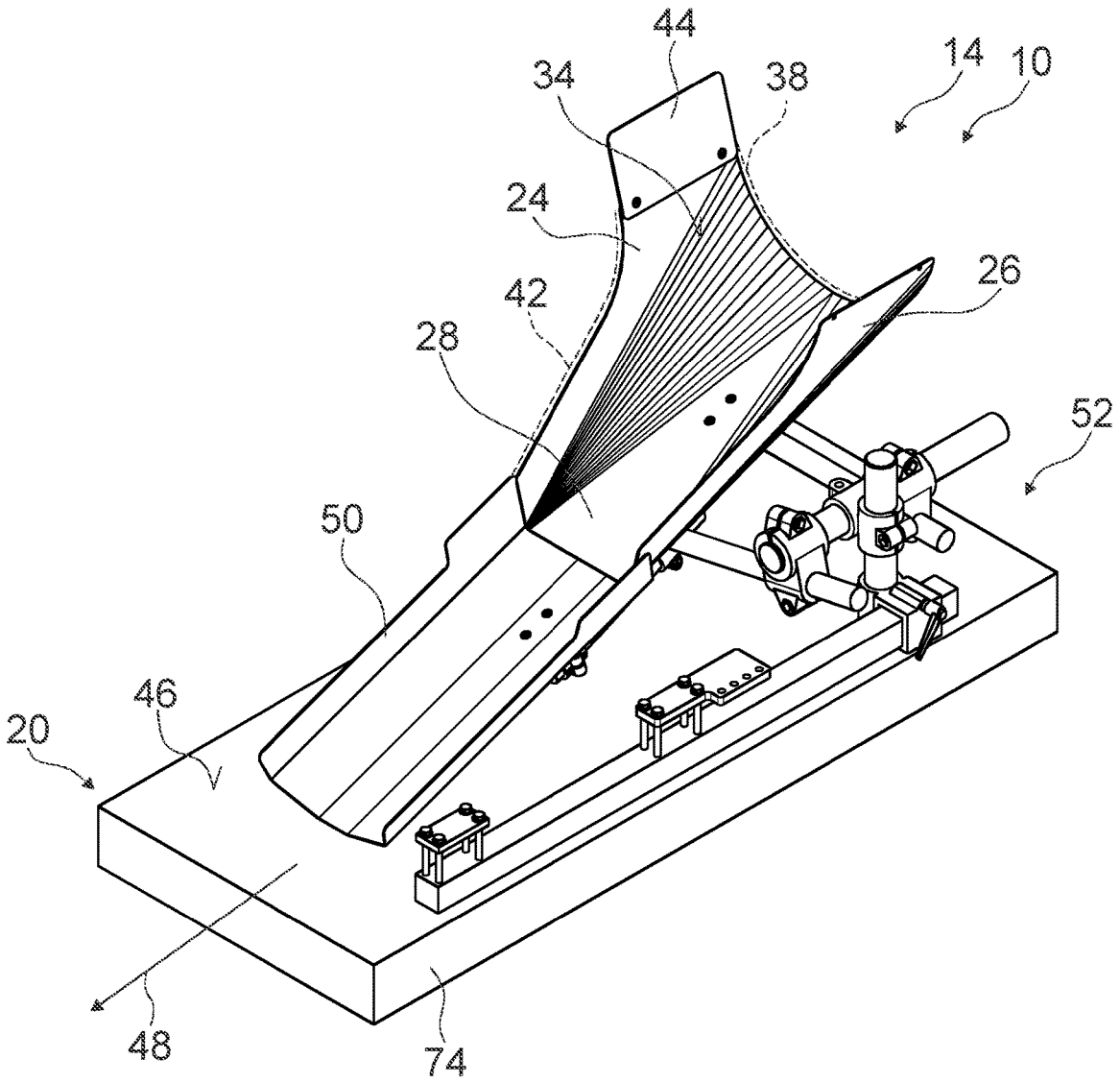
Figure 5:
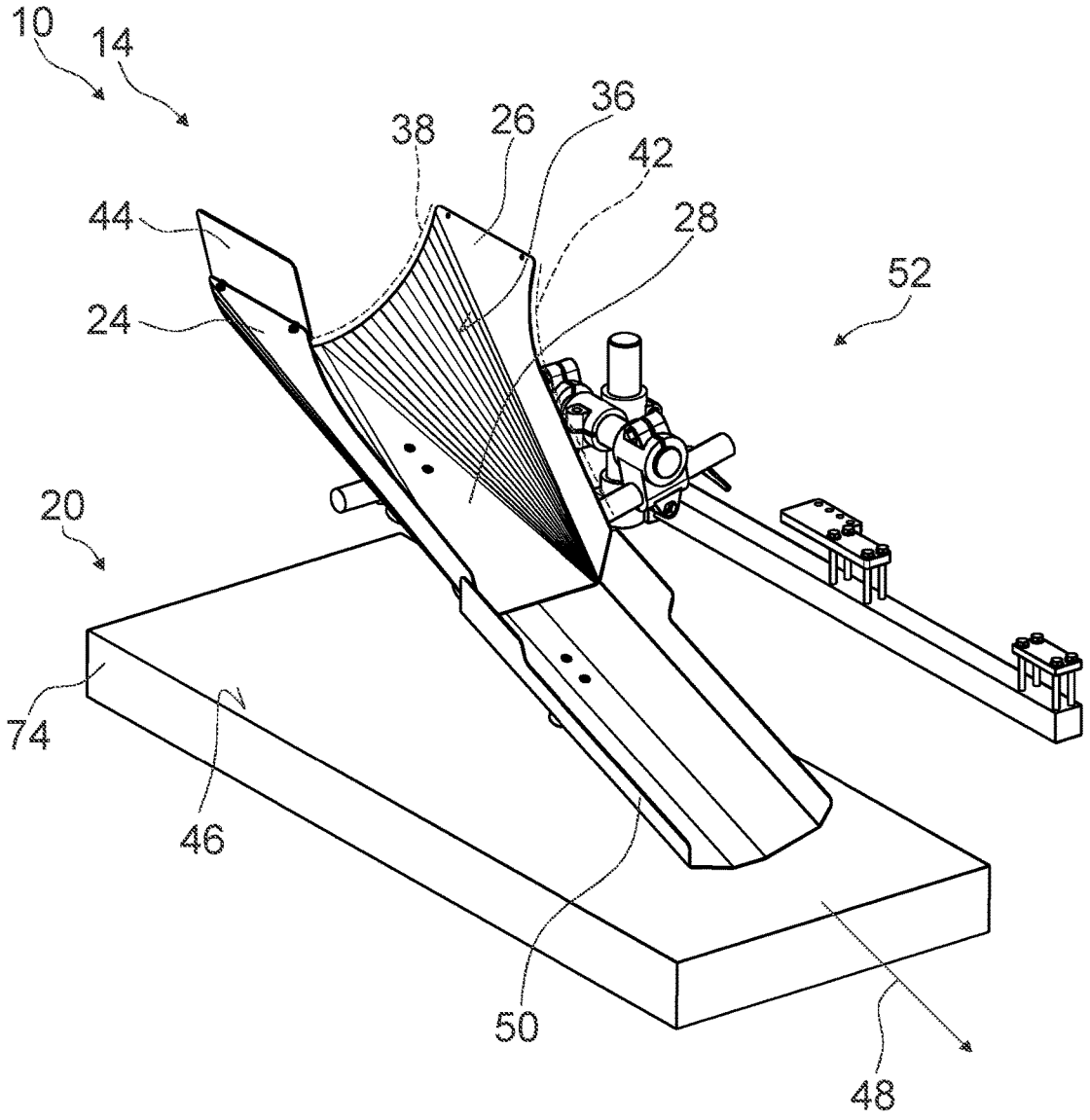

The transfer element 22 comprises at least one, in particular planar, middle surface 28 which connects the two sliding wings 24, 26 with each other (see FIGS. 3 to 5). Preferably, the middle surface 28 is implemented integrally with the two sliding wings 24, 26. In particular, the two sliding wings 24, 26 directly extend into the middle surface 28. The sliding wings 24, 26 can have rounded passages to run into the middle surface 28 or the sliding wings 24, 26 can have angled segments to run into the middle surface 28.

Figure 2:
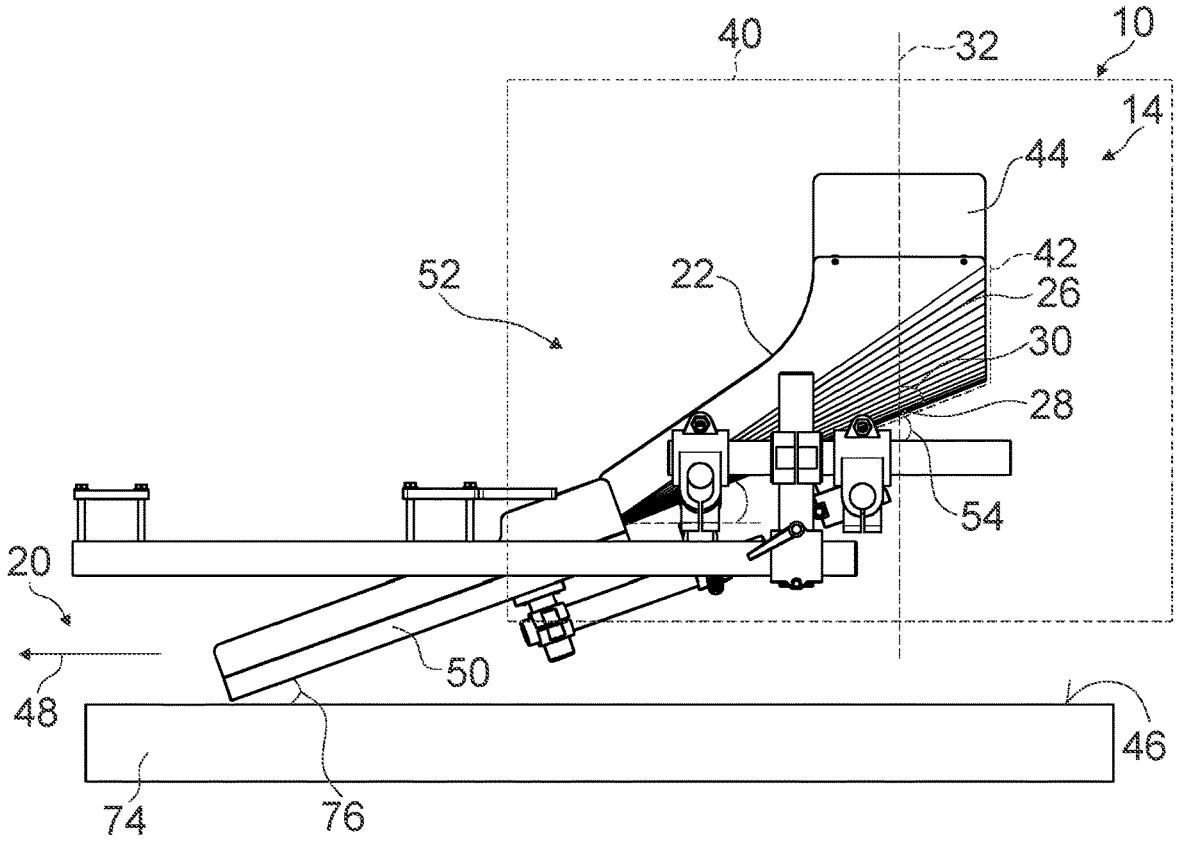

The middle surface 28, in particular viewed on a side of the transfer element 22 facing towards the vertical form fill and seal machine 12, is inclined, in particular with an angle 30 between 0° and 90°, relative to the cross plane 32 of the transfer element 22, which extends at least substantially perpendicular to the sliding surfaces 34, 36 of the sliding wings 24, 28 (see FIG. 2). Preferably, the middle surface 28, in particular viewed on a side of the transfer element 22 facing towards the vertical form fill and seal machine, is inclined with an angle 30 between 10° and 80°, advantageously with an angle 30 between 30° and 80° and especially advantageously with an angle 30 between 60° and 75° relative to the cross plane 32 of the transfer element 22. Preferably, the middle surface 28, in particular viewed on a side of the transfer element 22 facing away from the vertical form fill and seal machine 12, is inclined with an angle between 90° and 180°, advantageously with an angle between 100° and 160° and especially advantageously with an angle between 105° and 135° relative to the cross plane of the transfer element. The cross plane 32 of the transfer element 22 runs preferably at least substantially perpendicular to the main transportation direction 48 of the transport device 20, in particular of the transport belt 74. In particular, the cross plane 32 of the transfer element 22 runs preferably at least substantially perpendicular to the transportation plane 46 of the transport device 20, in particular of the transport belt 74.

Furthermore, the middle surface 28 is inclined relative to the transportation plane 46 of the transport device 20 and/or relative to the main transportation direction 48 of the transport device 20 (see FIG. 2). Preferably, the middle surface 28 is inclined with a transfer angle 54 less than 45°, advantageously with a transfer angle 54 less than 35° and especially advantageously with a transfer angle 54 between 5° and 30° relative to the transportation plane 46 of the transport device 20, in particular of the transport belt 74, and/or relative to the main transportation direction 48 of the transport device 20.

The transfer element 22, viewed in the cross plane 32 of the transfer element 22, which extends at least substantially perpendicular to the sliding surfaces 34, 36 of the sliding wings 24, 26, has a cross section 38 with an angled and/or an arcuate extension and, viewed in another cross plane 40 of the transfer element 22, which extends at least substantially perpendicular to the cross plane 32, has another cross section 42 with an angled and/or an arcuate extension (see FIGS. 2 and 3).

Moreover, the transfer unit 14 comprises an extension element 44 arranged or can optionally be arranged on at least one of the sliding wings 24, 26, wherein the extension element 44 lengthens a maximum extension of the at least one sliding wing 24, 26 on which the extension element 44 is arranged compared to a maximum extension of the at least one sliding wing 24, 26 which is free of the extension element 44, viewed along a direction which is at least substantially parallel to the cross plane 32 of the transfer element 22, which extends at least substantially perpendicular to the sliding surfaces 34, 36 of the sliding wings 24, 26 (see FIGS. 2 to 5).

The transfer unit 14 comprises at least one ramp element 50 arranged between the transfer unit 14 and the transport device 20, wherein the ramp element 50 is inclined relative to the transportation plane 46 of the transport device 20 and/or relative to the main transportation direction 48 of the transport device 20. The ramp element 50 can be implemented integrally with the transfer element 22, in particular with the middle surface 28, or the ramp element 50 can be embodied separate to the transfer element 22, wherein the ramp element 50 is arranged next to the transfer element 22 or fixed to the transfer element 22. Preferably, the ramp element 50 is inclined with an angle 76 less than 45°, advantageously with an angle 76 less than 35° and especially advantageously with an angle 76 between 5° and 30° relative to the transportation plane 46 of the transport device 20, in particular of the transport belt 74, and/or relative to the main transportation direction 48 of the transport device 20. The angle 76 with which the ramp element 50 is inclined relative to the transportation plane 46 of the transport device 20, in particular of the transport belt 74, and/or relative to the main transportation direction 48 of the transport device 20 can have the same value as the angle 74 with which the middle surface 28 is inclined relative to the transportation plane 46 of the transport device 20, in particular of the transport belt 74, and/or relative to the main transportation direction 48 of the transport device 20. Preferably, a value of the angle 76 with which the ramp element 50 is inclined relative to the transportation plane 46 of the transport device 20, in particular of the transport belt 74, and/or relative to the main transportation direction 48 of the transport device 20 differs from a value of the transfer angle 54 with which the middle surface 28 is inclined relative to the transportation plane 46 of the transport device 20, in particular of the transport belt 74, and/or relative to the main transportation direction 48 of the transport device 20 (see FIG. 2).

The vertical form fill and seal machine 12 or the discharging device 10 comprises an adjusting unit 52 by which the transfer unit 14 is moveably supported to adjust a position of the transfer unit 14 relative to the transport device 20, in particular at least the transfer angle 54 of the middle surface 28 of the transfer element 22 relative to the transportation plane 46 of the transport device 20 (see FIGS. 2 to 5). The adjusting unit 52 can be configured to adjust a position of the transfer unit 14 relative to the transport device 20 stepless or in steps. Moreover, the adjusting unit 52 can be configured to adjust a position of the ramp element 50 relative to the transport device 20 and/or the transfer element 22 stepless or in steps.

What is claimed is:

1. A discharging device for a vertical form fill and seal machine, comprising at least one transfer unit (14) to transfer sealed bags (16) from a sealing device (18) of the vertical form fill and seal machine to a transport device (20) located downstream with respect to the vertical form fill and seal machine, wherein the transfer unit (14) comprises at least one transfer element (22) arrangeable between the sealing device (18) and the transport device (20), wherein the transfer element (22) is provided to change an orientation of the sealed bags (16) during a transfer from the sealing device (18) to the transport device (20), wherein the transfer element (22) is embodied as a chute with two opposite arranged sliding wings (24, 26) on which the sealed bags (16) can slide during a transfer from the sealing device (18) to the transport device (20), wherein viewed along a main transportation direction (48) of the transport device (20), the transfer element (22) has a tapered shape, wherein the sliding wings (24, 26) have an inclination relative to each other, wherein the transfer element (22) comprises a middle surface (28) that connects the two sliding wings (24, 26) with each other, wherein, viewed in a cross plane (32) that intersects the transfer element (22), a cross section (38) of the transfer element (22) as a whole, starting from one of the sliding wings (24, 26), has a curved shape or a shape divided into segments that transitions into a planar or linear section that is formed by the middle surface (28) that transitions into another curved shape or another shape divided into segments that transitions to another of the sliding wings (24, 26), and wherein the cross plane (32) of the transfer element (22) extends perpendicularly to a transportation plane (46) of the transport device (20) and extends perpendicularly to the main transportation direction (48) of the transport device (20).

2. The discharging device according to claim 1, wherein the middle surface (28) is inclined relative to the cross plane (32).

3. The discharging device according to claim 1, wherein the transfer element (22), viewed in another cross plane (40) of the transfer element (22) extending perpendicular to the cross plane (32), has another cross section (42) with an angled and/or an arcuate extension.

4. The discharging device according to claim 1, wherein the transfer element (22) has a U-shaped cross section (38), viewed in the cross plane (32).

5. The discharging device according to claim 1, wherein the transfer unit (14) comprises an extension element (44) arranged on at least one of the sliding wings (24, 26), wherein the extension element (44) lengthens a maximum extension of the at least one sliding wing (24, 26) on which the extension element (44) is arranged compared to a maximum extension of the at least one sliding wing (24, 26) that is free of the extension element (44), viewed along a direction which is at least substantially parallel to the cross plane (32).

6. The discharging device according to claim 1, wherein the transfer element (22) comprises interim passages between the sliding wings (24, 26) and the middle surface (28) which are rounded or which are divided in angled segments to connect the sliding wings (24, 26) with the middle surface (28).

7. A vertical form fill and seal machine comprising at least one sealing device (18) and at least one discharging device according to claim 1 to discharge sealed bags (16) to the transport device (20).

8. The vertical form fill and seal machine according to claim 7, wherein the middle surface (28) is inclined relative to the transportation plane (46) of the transport device (20) and/or relative to the main transportation direction (48) of the transport device (20).

9. The vertical form fill and seal machine according to claim 8, wherein the transfer unit (14) comprises at least one ramp element (50) arranged between the transfer element (22) and the transport device (20), wherein the ramp element (50) is inclined relative to the transportation plane (46) of the transport device (20) and/or relative to the main transportation direction (48) of the transport device (20).

10. The vertical form fill and seal machine according to claim 7, wherein the transfer unit (14) comprises at least one ramp element (50) arranged between the transfer element (22) and the transport device (20), wherein the ramp element (50) is inclined relative to the transportation plane (46) of the transport device (20) and/or relative to the main transportation direction (48) of the transport device (20).

11. The vertical form fill and seal machine according to claim 7, further comprising an adjusting unit (52) by which the transfer unit (14) is moveably supported to adjust a position of the transfer unit (14) relative to the transport device (20).

12. A production system comprising at least one vertical form fill and seal machine according to claim 7 and at least one transport device (20) located downstream with respect to the vertical form fill and seal machine.

13. The vertical form fill and seal machine according to claim 7, further comprising an adjusting unit (52) by which the transfer unit (14) is moveably supported to adjust at least a transfer angle (54) of the middle surface (28) of the transfer element (22) relative to the transportation plane (46) of the transport device (20) and/or an angle of a ramp element (50) of the transfer unit (14) relative to the transportation plane (46) of the transport device (20).

14. A method for discharging to a transport device (20) sealed bags (16) from a sealing device (18) of a vertical form fill and seal machine using a discharging device, wherein the discharging device comprises at least one transfer unit (14) to transfer sealed bags (16) from the sealing device (18) of the vertical form fill and seal machine to the transport device (20) located downstream with respect to the vertical form fill and seal machine, wherein the transfer unit (14) comprises at least one transfer element (22) arrangeable between the sealing device (18) and the transport device (20), wherein the transfer element (22) is provided to change an orientation of the sealed bags (16) during a transfer from the sealing device (18) to the transport device (20), wherein the transfer element (22) is embodied as a chute with two opposite arranged sliding wings (24, 26) on which the sealed bags (16) can slide during a transfer from the sealing device (18) to the transport device (20), wherein viewed along a main transportation direction (48) of the transport device (20), the transfer element (22) has a tapered shape, wherein the sliding wings (24, 26) have an inclination relative to each other, wherein the sliding wings (24, 26), viewed in a cross plane (32) that intersects the transfer element (22), have a curved shape or a shape divided into angled segments, wherein the cross plane (32) of the transfer element (22) extends perpendicularly to a transportation plane (46) of the transport device (20) and extends perpendicularly to the main transportation direction (48) of the transport device (20), and wherein the sealed bags (16) are discharged from the sealing device (18) into the transfer element (22) on one side of the transfer element (22), wherein the sealed bags (16) slide from one side of the transfer element (22) to an opposite side of the transfer element (22) a plurality of times, wherein the sealed bags (16) slide from one of the sliding wings (24, 26) to the other of the sliding wings (24, 26) along sliding surfaces (34, 36) of the sliding wings (24, 26).

15. The method according to claim 14, wherein the sealed bags (16) are discharged from the sealing device (18) into the transfer element (22) in such an orientation that cross seal seams (72) of the sealed bags (16) are oriented parallel to the sliding surfaces (34, 36) of the sliding wings (24, 26) and/or to the main transportation (48) direction of the transport device (20).

16. A method for discharging to a transport device (20) a sealed bag (16) from a sealing device (18) of a vertical form fill and seal machine using a discharging device for the vertical form fill and seal machine, method including providing the discharging device comprising at least one transfer unit (14) to transfer sealed bags (16) from the sealing device (18) to a transport device (20) located downstream with respect to the vertical form fill and seal machine, wherein the transfer unit (14) comprises at least one transfer element (22) arrangeable between the sealing device (18) and the transport device (20), wherein the transfer element (22) is provided to change an orientation of the sealed bags (16) during a transfer from the sealing device (18) to the transport device (20), wherein the transfer element (22) is embodied as a chute with two opposite arranged sliding wings (24, 26) on which the sealed bags (16) can slide during a transfer from the sealing device (18) to the transport device (20), wherein viewed along a main transportation direction (48) of the transport device (20), the transfer element (22) has a tapered shape, wherein the sliding wings (24, 26) have an inclination relative to each other, wherein the transfer element (22) comprises a middle surface (28) that connects the two sliding wings (24, 26) with each other, wherein, viewed in a cross plane (32) that intersects the transfer element (22), a cross section (38) of the transfer element (22) as a whole, starting from one of the sliding wings (24, 26), has a curved shape or a shape divided into segments that transitions into a planar or linear section that is formed by the middle surface (28) that transitions into another curved shape or another shape divided into segments that transitions to another of the sliding wings (24, 26), and wherein the cross plane (32) of the transfer element (22) extends perpendicularly to a transportation plane (46) of the transport device (20) and extends perpendicularly to the main transportation direction (48) of the transport device (20), and discharging the sealed bags (16) from the sealing device (18) into the transfer element (22) on one side of the transfer element (22), wherein the sealed bags (16) slide from one side of the transfer element (22) to an opposite side of the transfer element (22) a plurality of times, wherein the sealed bags (16) slide from one of the sliding wings (24, 26) to the other of the sliding wings (24, 26) along sliding surfaces (34, 36) of the sliding wings (24, 26).

* * * * *